United States Patent [19]

Melcher et al.

[11] 4,038,049

[45] July 26, 1977

[54] ELECTROFLUIDIZED BEDS FOR COLLECTION OF PARTICULATE

[75] Inventors: James R. Melcher, Lexington, Mass.; Kenneth S. Sachar, White Plains, N.Y.; Karim Zahedi, Brookline, Mass.

[73] Assignee: Massachusetts Institute of Technology, Cambridge, Mass.

[21] Appl. No.: 516,057

[22] Filed: Oct. 18, 1974

[51] Int. Cl.[2] ..... B03C 3/00

[52] U.S. Cl. ..... 55/2; 55/99; 55/128; 55/138; 55/155; 55/270; 55/474; 55/466

[58] Field of Search ..... 55/2, 4, 12, 13, 14, 55/96, 97, 98, 99, 101, 103, 107, 108, 109, 112, 114, 115, 117, 118, 120, 123, 128, 129, 130, 131, 136, 138, 139, 140, 142, 150, 154, 155, 474, 270, 466; 117/73.4 R, 100 R, 93; 118/DIG. 5, 620, 634; 23/288 R, 288 S, 288 J, 284; 48/65, 208, 206; 204/164, 171; 75/10; 252/477 R; 13/2, 9, 23; 423/659, 415

[56] References Cited

U.S. PATENT DOCUMENTS

| | | | |
|---|---|---|---|
| 1,857,799 | 5/1932 | Winkler | 48/206 |
| 2,293,113 | 8/1942 | Carney | 55/474 X |
| 2,371,619 | 3/1945 | Hartley | 23/288 S X |
| 2,650,084 | 8/1953 | White | 23/288 S X |
| 2,689,973 | 9/1954 | Lee et al. | 55/474 UX |
| 2,799,640 | 7/1957 | Pevere et al. | 204/171 |
| 2,921,840 | 1/1960 | Johnson et al. | 48/65 X |
| 2,990,912 | 7/1961 | Cole | 55/130 |
| 3,006,838 | 10/1961 | Johnson | 118/DIG. 5 |
| 3,218,781 | 11/1965 | Alleman et al. | 55/138 X |
| 3,247,014 | 4/1966 | Goldberger et al. | 117/100 |
| 3,304,249 | 2/1967 | Katz | 204/164 |
| 3,305,466 | 2/1967 | McCoy | 204/164 |
| 3,365,858 | 1/1968 | Penney | 55/11 |
| 3,404,078 | 10/1968 | Goldberger | 204/164 |
| 3,499,947 | 3/1970 | Johnson | 252/477 R UX |

FOREIGN PATENT DOCUMENTS

| | | | |
|---|---|---|---|
| 96,717 | 9/1939 | Sweden | 55/107 |

*Primary Examiner*—Frank W. Lutter
*Assistant Examiner*—David L. Lacey
*Attorney, Agent, or Firm*—Arthur A. Smith, Jr.; Robert Shaw; Martin Santa

[57] ABSTRACT

Apparatus for the high performance collection of gas entrained particulate, especially submicron particulate, consisting of a fluidized bed of collection sites with an electric field imposed on the bed so that the particulate to be collected, which is charged prior to entering the bed with the fluidizing gas, is electrically induced to agglomerate with the bed particles and the collected matter is removed in a fluidized state with the bed particles, which can consist of the collected material itself.

22 Claims, 12 Drawing Figures

ELECTROFLUIDIZED BEDS FOR COLLECTION OF PARTICULATE

The present invention relates to systems for removing particulate from a gas in which it is entrained and, more specifically, to systems in which an electrofluidized bed (also called "EFB" herein) is employed to effect such removal.

In this time of high consciousness of pollution, an expanded effort has developed to decrease the amount of pollutant emitted to the environment. Of special interest is the removal of submicron particulate from flue gases and the like; said removal of such particulate occurs only with considerable expense in existing removal systems. It is, accordingly, a principal object of this invention to provide a system wherein submicron particulate is removed in an efficient manner from a gas within which it is entrained.

One difficulty in previously suggested systems for removal of submicron particulate is the long residence time required to effect even modest separation. Another object is to provide a removal system wherein the residence time is lowered from that of prior systems and efficiency is improved.

It is especially convenient to process the particulate, once removed from the gas, in a fluidized state. Another object is to provide a gas cleaning system in which the pollutant is naturally handled in a fluidized form.

Still another object is to efficiently collect materials, such as highly insulating particles, that are inefficiently collected by conventional electrostatic precipitators.

These and still further objects are evident in the description that follows.

The foregoing objects are achieved in a system wherein particulate is removed from a gas by passing the gas containing the particulate through an electrofluidized bed where it is collected. The collected matter in the fluidized state, together with the bed particles, is removed. The bed particles can be recycled or can be composed of agglomerates of the particulate itself. The electrofluidized bed is formed by creating an ambient electric field in the region occupied by a fluidized bed; the level of the ambient field is controlled thereby to affect particulate removal.

The invention is hereinafter discussed with reference to the accompanying drawing in which:

FIGS. 1A and 1B are schematic representations of electrofluidized bed configurations with imposed fields E for conditions of cross-flow and co-flow, respectively;

FIGS. 2A, 2B and 2C respectively represent a laminar flow model for collection on isolated bed particles, including the definitions of coordinates, ambient electric field intensity E and relative gas velocity U, represent the force lines in which positively charged particulate enter with the gas stream at $z \rightarrow \infty$ and for $E<0$, so those within the area $\pi y^2$ are collected by the particle, and represent the force lines in the case where according to the laminar flow model no positive particulate is collected if $E>0$, in both cases $|U| >> |bE|$;

Figure 6:
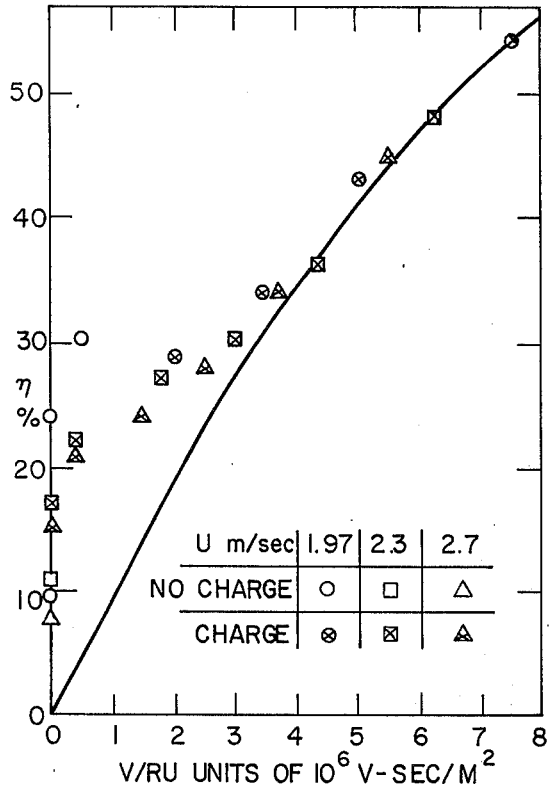
Figure 7:
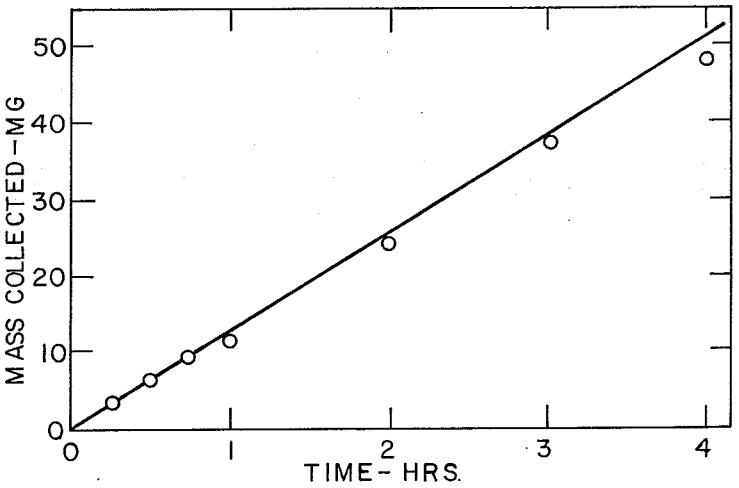
Figure 8:
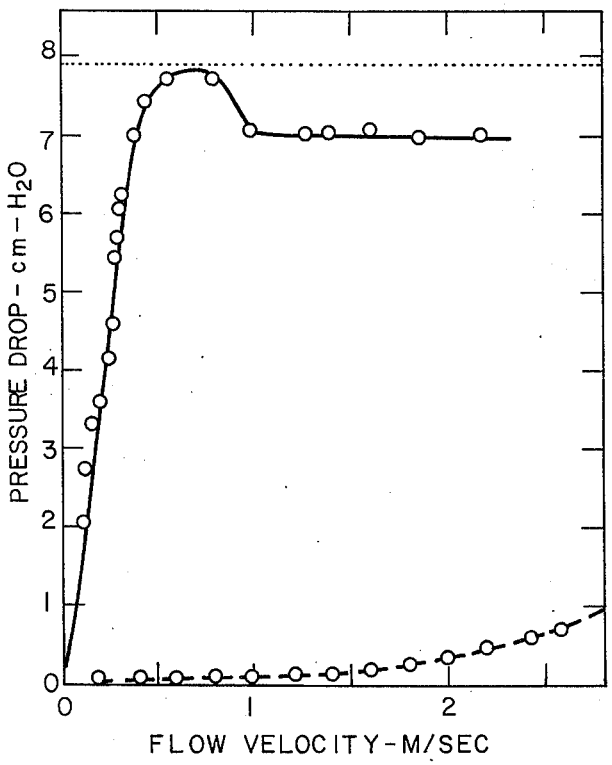
Figure 9:
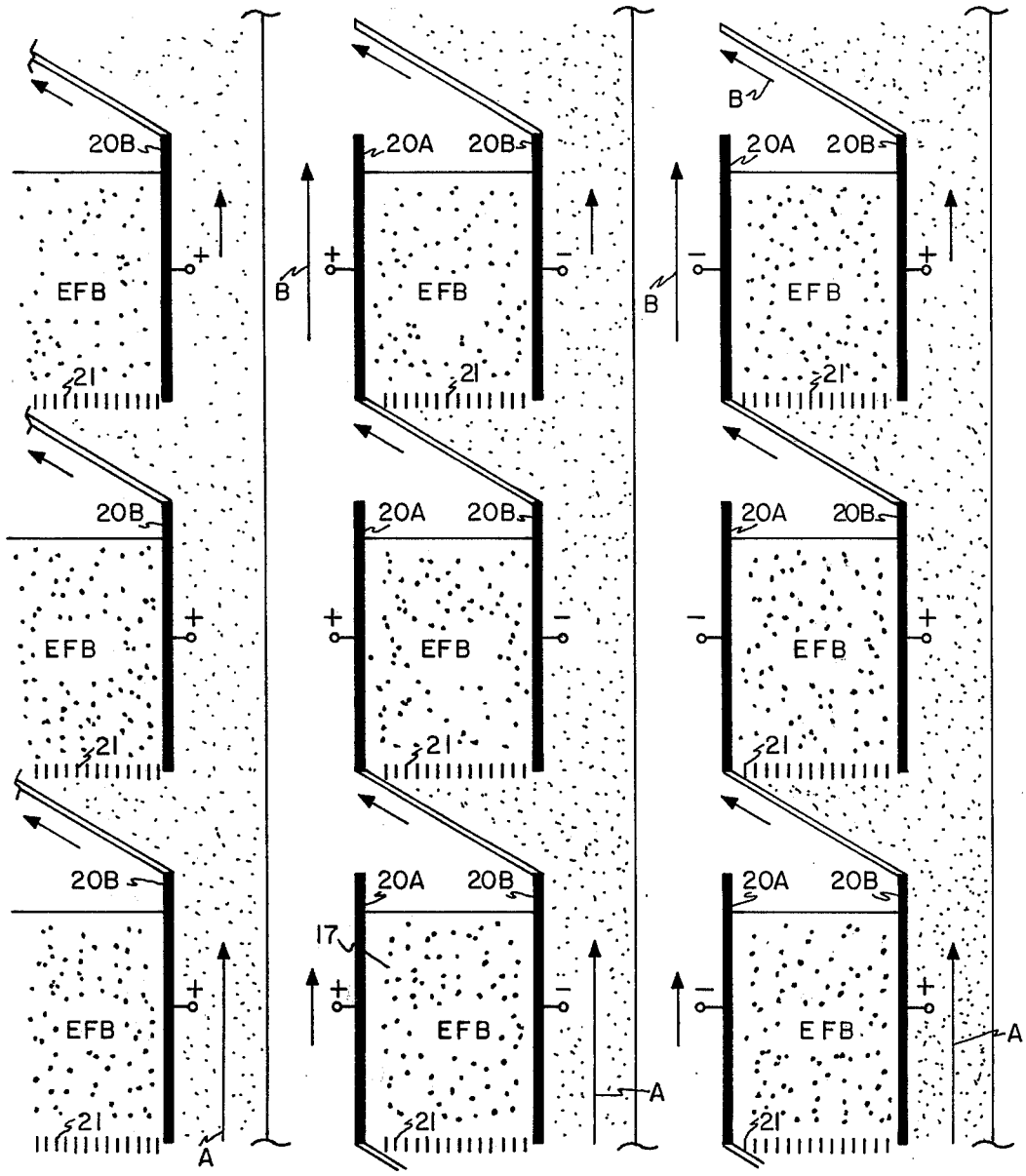

FIG. 6 summarizes the measured collection efficiency of an EFB as a function of voltage normalized to free-stream gas velocity and particle radius for three different velocities with various bed expansions for the three different velocities showing that all three tests approach the theoretically predicted solid curve as the imposed field dominates and confirming that performance depends on unfluidized bed height $l_o$ rather than fluidized height $l_f$;

FIG. 7 shows collection data as a function of tests prolonged to identify possible saturation effects due to particle charging with an unfluidized bed height $l_o = 5$ cm, $E = 0.75 \times 10^5$ volts/$m$ bed particle radius, $R = 1$ mm and $U = 2$m/sec together with a theoretical pressure drop, based on the assumption that charge collected by bed particles can relax from bed volume;

FIG. 8 summarizes typical pressure drop across a bed as a function of flow velocity, showing classic linear relation at flow rate below that required for incipient fluidization and constant pressure drop after fluidization with $l_o = 6$ cm, $R = 0.4$ mm together with the theoretical pressure drop (dotted line) for fluidized bed alone, where voidage at minimum fluidization is $\epsilon_{mf} = 0.49$, together with showing the pressure drop (broken line) across the distributor plate, which has been subtracted from the drop across the bed; and FIG. 9 is a schematic of a particulate removal system employing manifolded EFB's.

It is helpful to distinguish between two types of electrofluidized beds. In the first, the fluidized particles become charged because of frictional electrification, see J. Ciborowski and A. Wlodarski, "On Electrostatic Effects in Fluidized Beds," Chem. Eng. Sci. 17: 23 (1962) and Silverman et al, Letters Patent No. 2,992,700. In the second type of bed, described here as the basis for a class of high performance particulate control devices, the electric field is imposed by means of electrodes, see T. W. Johnson, "The Electromechanics of a Fluidized Bed of Insulating Particles," S. M. thesis, M.I.T., Cambridge, Mass., 1974, deposited in M.I.T. library system on or about June 25, 1974.

With the electrofluidized bed (termed an "EFB") functioning as a filter, the bed particles are used as collection sites. Rather than depend on natural electrification, as in previously described devices (see the Silverman et al Letters Patent), the beds of interest make use of an imposed ambient field to induce positive and negative charges on the respective ends of the particles. Such polarization occurs if the particles are conducting or insulating. Thus, with gas entrained particulate charged before entering the EFB, the poles of the particles collect oppositely charged particulate. The "cross-flow" and "co-flow" configurations shown on FIGS. 1A and 1B, respectively, illustrate typical ways in which the field can be imposed. The particles shown at 17 can be insulating, semi-insulating and, if there is sufficient fluidization, even highly conducting.

The major advantage in using the EFB stems from the significantly more extensive area available for precipitation, compared to the area of electrodes in a conventional electrostatic precipitator.

The nearest relatives of the EFB are the electrostatic precipitators and fixed or fiber filters. The idea of combining these types of devices, so as to increase the effective surface area of the precipitator and enhance the inertial impaction mechanism in the mechanical filter, has been the basis for studies of fields applied to fixed fiber filters in air. Using fields generated by frictional electrification, Johnstone (see Johnstone Letters Pat. No. 2,924,294) and Anderson and Silverman (see said Silverman et al Letters Patent) studied filtration by means of highly insulating packed and fluidized granules. These devices differ from that described here because here the electric field is imposed by means of electrodes. Empiricism is a prevailing theme of such studies. The lack of reliable quantitative models stems from difficulty in controlling experimental parameters. Fixed or essentially fixed beds of particles in an imposed electric field have seen some attention as the basis for particulate control devices (see Swedish Pat. No. 96,717 (Edholm) and Letters Pat. No. 2,990,912 (Cole)). The latter devices differ from that described here because here the beds are fully fluidized.

There are three stages to the gas cleaning process in the class of EFB, just as there are in a conventional electrostatic precipitator (ESP). First, the particulate is transferred from the gas to the precipitation surface. This is the surface of the bed particles in the case of the EFB and that of the precipitation electrodes in the case of an ESP. Second, agglomerates of the particulate are formed as a result of adhesion. In the EFB these form on the bed particles, or the agglomerates can be the bed particles. In the ESP the agglomeration occurs at the electrodes. Finally, the agglomerates are removed. In the EFB, the last stage involves the outflow of pollutant in a fluidized state. In the ESP, the removal is effected by tapping the agglomerated particulate from the electrodes into a hopper.

As a basis for a particulate collection model for EFB, the nature of the electrically dominated collection process by a single isolated particle is now considered. Pictured in detail, the collection process appears to be governed by a large number of highly variable factors. Some of these are:

i. Electrical properties of bed particles, especially the effective electrical conductivity. In the case of sand particles, the conduction is dominated by the absorption of water molecules onto the particle surfaces. Hence, in the absence of collected particulate on the bed particles, humidity controls conductivity, which can be varied over about four orders of magnitude. Typically, the sand particles used in experiments are mixed with air at 50% relative humidity and have relaxation times (that is, the time required for a particle to acquire a significant electrical charge when contacting a metallic electrode in an imposed field) of $\sim$ 0.1 sec.

ii. Electrical properties of particulate. By electrostatic standards, the dioctylphthalate (also called "DOP" herein) used in the studies described here are semi-insulating, with a bulk relaxation time in the range of $2 \times 10^{-2}$ sec. Upon collection, the DOP can also contribute to the particle conduction.

iii. The mobility of the particulate and the imposed field strength, which determine the particulate velocity relative to the gas velocity. In the experiments, the particulate mobility is $b \approx 10^{-7}$m/sec/volt/m, electric fields imposed are at most $4 \times 10^5$ volts/m, and gas velocities relative to the bed are typically 2m/sec. Hence, the electrically induced velocity of the particulate, $bE \sim$ 4cm/sec, is much less than that of the gas.

iv. The nature of the gas flow relative to the particle, that is, whether it is turbulent or laminar on a scale typified by the interparticle spacing.

In spite of the apparent complexity of the collection process, the performance of an EFB filter, consisting of sand particles filtering submicron dioctylphthalate(-DOP), can be reliably predicted. This is in part because the residence time requirement for cleaning is relatively insensitive to whether or not the particles instantaneously carry net charge, and because the flow is turbulent and not laminar.

Table 1 summarizes the rate of particulate collection $\Gamma$ for a single particle, determined for a sequence of limiting cases. Laminar flow models are introduced to make it clear by comparison to experimental results that they are not appropriate. The collection rates for different particle "states" illustrates that the basis residence time is not sensitive to the details of the interaction.

Table 1

Figure 2A:
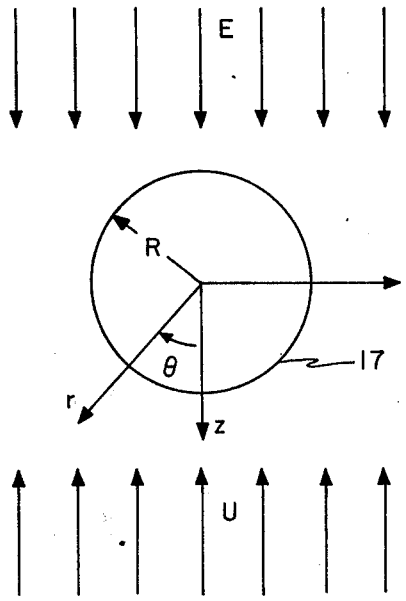

Summary of collection rates $\Gamma$ (pollutant particles/sec) for isolated bed particles depicted by FIG. 2A.

$$\Gamma_{\pm} = \pi R^2 b_{\pm} n_{\pm} |E| \text{ and } Q_c \equiv 12\pi R^2 \epsilon_o |E|.$$

| Bed Particle Property | Bed Particle Charge | Flow Model $\Gamma$ | |
|---|---|---|---|
| insulating $c = \epsilon/(\epsilon + 2\epsilon_o)$ | 0 | Laminar | $E < 0$ $3c\Gamma_+$<br>$E > 0$ $3c\Gamma_-$ |
| conducting $c = 1$ | 0 | Laminar | $E < 0$ $3\Gamma_+$<br>$E > 0$ $3\Gamma_-$ |
| insulating $c = \epsilon/(\epsilon + 2\epsilon_o)$ | 0 | Turbulent | $3(\Gamma_+ + \Gamma_-)$ |
| conducting $c = 1$ | 0 | Turbulent | $3(\Gamma_+ + \Gamma_-)$ |
| conducting $c = 1$ | Q | Turbulent | $3\left[(\Gamma_+\left(1 - \frac{Q}{Q_c}\right)^2 + \Gamma_-\left(1 + \frac{Q}{Q_c}\right)^2\right]$ |

In connection with the models of Table 1, an isolated particle of radius R is envisioned as being stationary (in a fluidized state) as shown by FIG. 2A. The particulate laden gas moves around it with vertical velocity U far from the particle. The ambient electric field, having magnitude E, is also vertically directed and positive if directed downward, as shown in FIG. 2A. With a correction for the average effects of the surrounding bed particles, this is the voltage divided by distance between screens, in the co-flow configuration of FIG. 1B wherein the screens are labeled 3A, 3B, 4A and 4B.

Some of the terms in Table 1 are mentioned elsewhere in this specification or are known to workers in the art to which this specification is directed but, in the interest of clarity, are given here:

- c is electric field concentration factor defined in Table 1;
- $\epsilon$ is particle permittivity;
- $b_-$ indicates mobility of negatively charged pollutant particles;
- $b_+$ is mobility of positively charged pollutant particles;
- $\Gamma$ is number of pollutant particles per second collected by bed particles;
- $\Gamma_+$ is defined in Table 1;
- $\Gamma_-$ is defined in Table 1;
- $\epsilon_o$ is permittivity of free space;
- $|E|$ is the microscopic electric field in the immediate vicinity of a bed particle and is comparable to the macroscopic field E (which is equal to $V/d$, wherein V is the voltage applied to electrodes to charge the bed particles and $d$ is the distance between the electrodes, as later discussed);
- Q is the instantaneous charge on a bed particle;
- $Q_c$ is defined in Table 1;
- $n_+$ indicates the number density of positively charged pollutant particles; and
- $n_-$ indicates the number density of negatively charge pollutant particles.

Figure 1A:
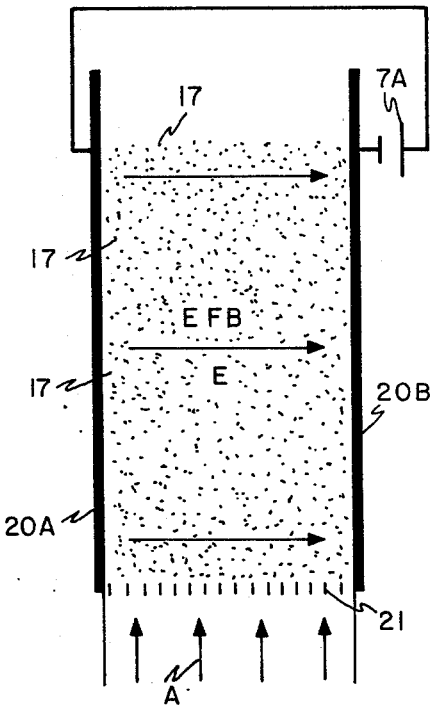
Figure 2B:
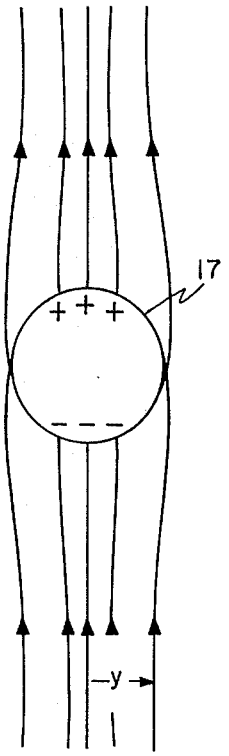

In sequence, these are now considered the limiting cases summarized in Table 1. First, it is assumed that the sand particles 17 in FIG. 1A are perfectly insulating. This appears to be the case before filtration commences at low relative humidity. The possible trajectories of positively charged particulate are shown in FIG. 2B. Collection occurs over the nearer hemisphere, which (at a rate $\Gamma$ spheres of particulate/sec/bed particle) intercepts all of the particulate entering through the area $\pi y^2$. It should be noted that so long as $|U| > |bE|$ this collection rate is independent of U.

Figure 2C:
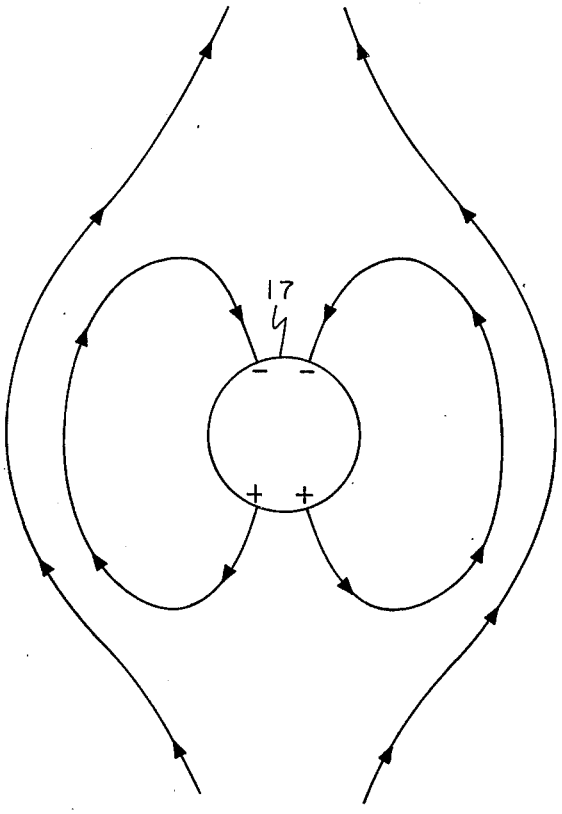

If the electric field is reversed, positive particulate follow the trajectories shown in FIG. 2C. Because none of the trajectories entering from below, where the particulate must originate, end on the particle surface, there is no collection of positive particulate in this case. Following the same line of reasoning, negative particulate is not collected in regions where $E < 0$, but is collected where $E > 0$.

The only effect of making the particle highly enough conducting that the surface remains an equipotential is that the factor of $3\epsilon/(\epsilon+2\epsilon_o)$ is replaced by its limit as $\epsilon \rightarrow \infty$ in the expression for $\Gamma$.

The well defined trajectories are of course only possible if the gas flow is laminar. Turbulence is the very nature of a gas-solid fluidized bed. In fact, it is to be expected that mixing must have a radical influence on the distribution of particulate in the voidage region between particles. Following the lead suggested by a "Deutsch equation approach" to representing the collection in a conventional ESP, the extreme effect of the mixing is to supply particulate to all of the particle surface. Thus, by the turbulent flow models, it is meant that the densities of positive and negative particulate, $n_+$ and $n_-$, are uniform throughout the voidage. Then, both hemispheres of the particles are active in the collection regardless of the polarity of E. The resulting collection rates for the cases of insulating and conducting particles in turbulent flows are therefore as summarized in Table 1.

Figure 3:
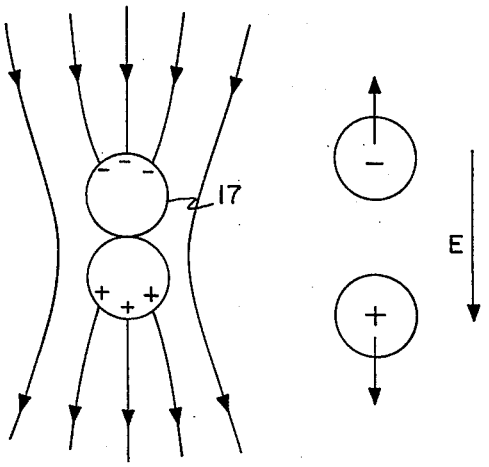
FIG. 3 is a representation of charging caused by collision between semi-insulating particles in an imposed electric field, which can be caused by mechanical turbulence at low fields or by electromechanical "heating" at high field strengths.

Collisions between the bed particles, stressed as they are by an ambient electric field, must result in some net charge being carried by a particle at any given instant. How important is this charge in the collection process? A collision that results in the maximum possible net charge, starting from initially neutral particles, is sketched in FIG. 3. If the particles have electrical relaxation times short compared to the time they are in contact, charge redistributes itself, as shown, much as if the two instantaneously form a single particle. At low field strengths, separation is caused by the bed fluid mechanics, while at higher field strengths, the induced electrical forces associated with the net charge on each particle and the ambient electric field cause the repulsion of the particles. In fact, after collision the bed particles can be re-accelerated by the field until they encounter other particles where the charge transfer process occurs once again. High field strengths can give rise to an electromechanical "heating" of the bed which is analogous to the random thermal motions of molecules. So far as the EFB acting as a filter is concerned, practical field strengths are sufficiently low that effects on the bed mechanics need not be of immediate concern.

With the assumptions that the flow is turbulent and the bed particles are conducting, the theoretical collection rate for an isolated bed particle is found to be related to not only the ambient field, but also the instantaneous net charge Q, as summarized in Table 1. Because Q is continually alternating in sign and changing magnitude, the effect of Q on the collection rate of a given particle is likely to average out. Experiments support the view that the most meaningful model for the collection represents the single particle as conducting and surrounded by flow characterized by turbulent mixing, ...$\Gamma = 3(\Gamma_+ + \Gamma_-)$. However, so that the insulating particle model can also be compared to the experimental results, $\Gamma = 3c[\Gamma_+ + \Gamma_-]$, where for conducting and insulating particles, $c = 1$ and $C = \epsilon/(\epsilon+2\epsilon_o)$, respectively.

conservation of particulate having density $n$ (the sum of positive and negative particulate densities) as it passes through a uniform cross-section fluidized bed of N particles per unit volume requires that the difference between the rate of flow of particulate through the cross-section in the vertical plane $z + dz$ differ from that at $z$ by the rate at which particulate is collected within the volume $A\Delta z$.

$$UAn(z + \Delta z) - UAn(z) = -\Gamma NA\Delta z \quad (1)$$

Here, U is the gas velocity outside the bed, A is the cross-sectional area of the bed and hence UA, the volume rate of gas flow, is constant throughout the bed. With $\Gamma$ given by Table 1, the limit $\Delta z \rightarrow 0$ of Eq. (1) gives (2)

-continued $$\frac{dn}{dz} = \frac{-n}{l_c}; \; l_c = U/3\pi cR^2 b\,|E|N$$

Hence, it follows that the collection process has the exponential character of the Deutsch model for the conventional ESP. The collection efficiency for a bed having the fluidized length $l_f$ and initial particulate density $n_o$ follows from Eq. (2) as $$\eta = \frac{n_o - n}{n_o} = 1 - \exp(-l_f/l_c) \tag{3}$$

If ($\alpha$ $R$) is defined as the mean distance between particle centers, then $N = (\alpha R)^{-3}$ and the ratio of fluidized height to unfluidized height $l_o$ is (taking $\alpha \cong 2$ for the latter case) $(\alpha/2)^3$. Thus, in Eq. (3), $l_f/l_c$ can also be written as $$\frac{l_f}{l_c} = \frac{3\pi}{8} c \left(\frac{l_o}{R}\right) \frac{b\,|E|}{U} \tag{4}$$

This is a convenient form, because it shows the efficiency is basically dependent on the unfluidized height of the bed. If means were available for expanding a bed while keeping U constant, according to this model, the increased bed length and mean particle spacings would have canceling effects. Note that R plays a role in Eqs. (3) and (4) analogous to the electrode spacing in a conventional ESP. Efficiency increases as R decreases. Of course for a given U there is a lower limit on R set by the requirement that there be no particle elutriation.

Although U is defined as the mean gas velocity above the bed (and not in the void space of the bed), $|E|$ is a "microscopic" field experienced by the individual particles. At close packings, this can appreciably exceed the ambient "macroscopic" field (the voltage divided by the distance between electrodes, i.e., V/d). An estimate of the effect of field concentration can be obtained by a Classius-Mossotti type model. This results in an effective electric field which can be used to replace $|E|$ in Eq. (2) to account for the field intensification $$|E| \rightarrow |V/d| / \left[ -\left(\frac{4\pi}{3}\right) \frac{c}{\alpha^{3\prime}} \right] \tag{5}$$

Typically, this correction is ($c = 1$, $\alpha = 3$) $|E| \rightarrow 1.19\,|V/d|$ and probably is not significant compared to other inaccuracies built into the model.

Inertial impaction is one of two additional collection mechanisms which would be expected to contribute in an EFB. For submicron particulate, the inertial impact scrubbing is characterized by the time constant $$\tau_{sc} = \frac{3\eta_c^2}{U^3 N a^4 \rho_a^2} \tag{6}$$

where $\eta_c^2$ is the gas viscosity corrected by the Cunningham factor, $a$ is the radius of the particulate and $\rho_a$ is its mass density. If this cleaning mechanism is to be significant, $\tau_{sc}$ must be short compared to the gas residence time.

If the particulate is charged to one polarity, a second mechanism for cleaning is space-charge precipitation. The characteristic time for removal by this mechanism is $$\tau_a = \frac{\epsilon_o}{nqb} \tag{7}$$

For bicharged particulate this is also the characteristic time for self-discharge and hence loss of particulate from the EFB for lack of a charge. Values typical of the experiments described hereinafter are $\tau_{sc} = 10^2$ sec and $\tau_a > 10^2$ sec. Because these times are far longer than the typical residence time (0.05 sec), the collection due to inertial impaction and self-precipitation is negligible. Also, even where loadings of particulate are so extreme that $nq$ is as much as $10^{-4}$Coul/m$^3$, $\tau_a$ for submicron particulate is of the order of seconds. Thus, self-discharge of bicharged particulate is not likely to pose a limitation in the use of the EFB.

Figure 5:
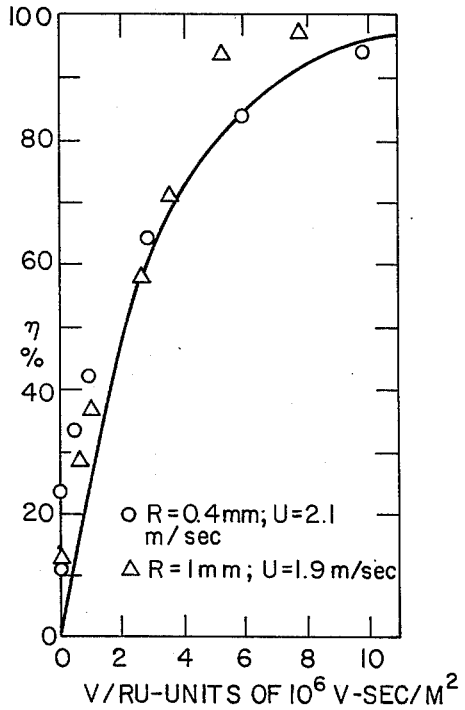
FIG. 5 shows typical collection efficiency data obtained using EFB's respectively having bed particles of diameters 0.8 and 2mm, as a function of voltage V normalized to free stream velocity U and bed particle radius R and curves predicted by theory with the unfluidized bed height $l_o = 6$ cm in both cases.

To establish that Eq. (3) gives a meaningful representation of the collection efficiency, and hence can be used for design purposes, tests have been conducted which emphasize the dependence on three parameters: electric field intensity, bed particle size, and relative fluidization. Efficiencies found for sand particles having mean diameter 0.8 and 2mm are summarized in FIG. 5. In each case, the parameter V/RU is varied by changing the voltage from zero to a maximum of 15 kv (which makes $E = 3.75 \times 10^5$volts/m). The theoretical curve is calculated from Eq. (3) using $c = 1$. Reversal of the voltage results in no appreciable change in collection efficiency. If a laminar collection model were appropriate, the reversal would have the effect of replacing one active region of the bed by two.

The major uncertainty is in the amount of charged aerosol injected into the bed. In one of two techniques used to determine the absolute amount injected, the dioctylphthalate (DOP) is precipitated on electrodes in a separated apparatus. These are washed in alcohol to remove the DOP and the solution then subjected to ultraviolet absorption analysis to determine the absolute amount. The second method makes use of an optical extinction measurement to infer the aerosol number density. This, together with a knowledge of the flow rate, gives the amount of DOP injected. The results of these measurements brackets values inferred by plotting the amount of DOP collected (on semi-log paper) as a function of voltage, and extrapolating the linear curve found (for voltages above about 3 $kV$) to zero voltage to determine the amount injected. These three methods agree to within about 15%.

Figure 1B:
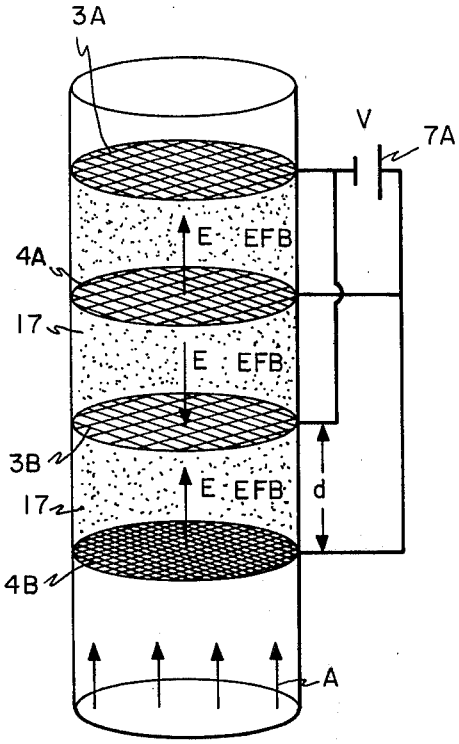
Figure 4:
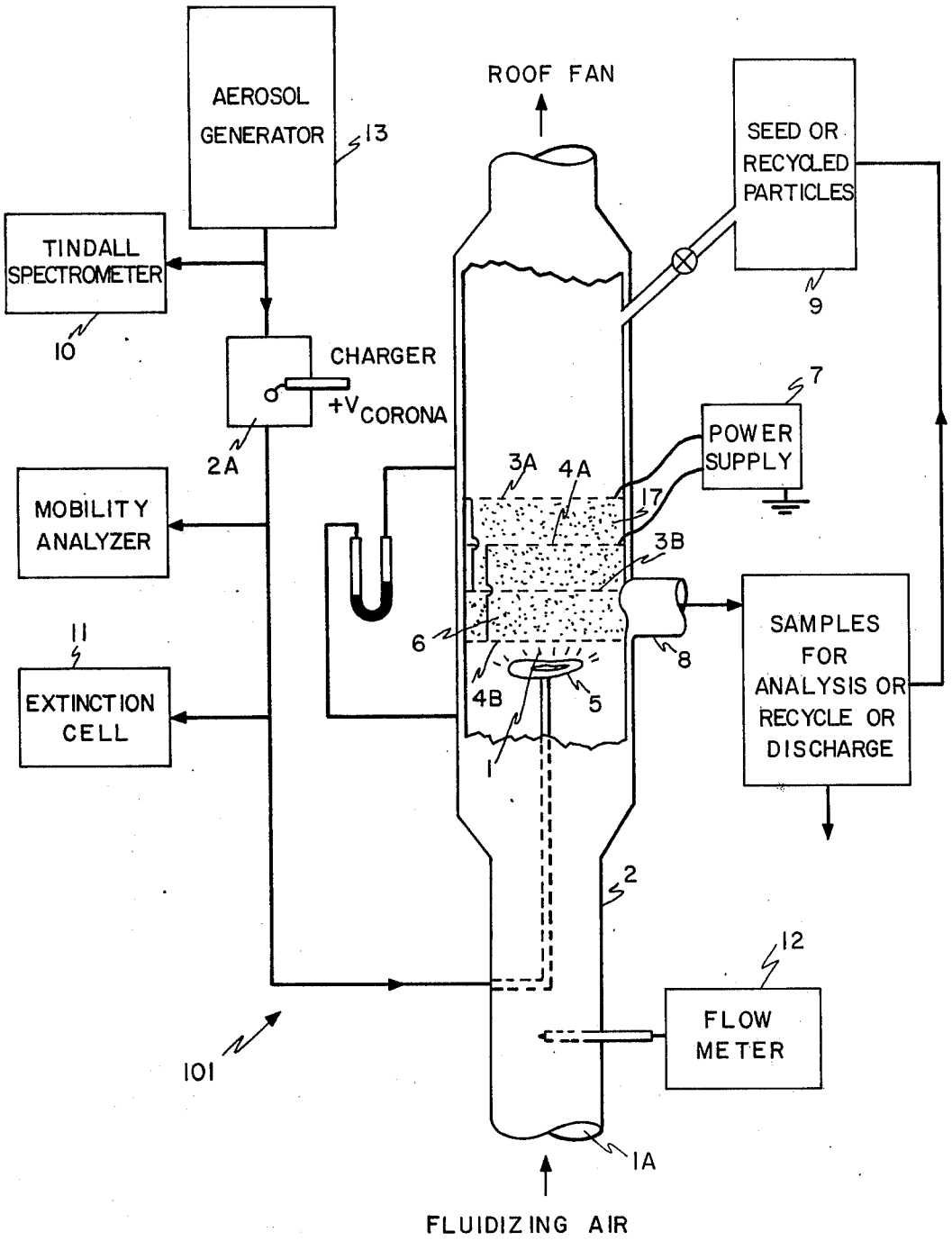
FIG. 4 shows schematically, partly cutaway and partly in block diagram form, test apparatus incorporating four screen electrodes in the co-flow configuration.

The test apparatus labeled 101 in Fig. 4 is a co-flow configuration similar to FIG. 1B. Air containing entrained particulate enters a stack or housing 2 via a raw gas inlet 1A and is received at the lower end 1 of the EFB as the gas flows past an injection pipe 5 in the test apparatus where it is mixed with negatively charged particles just prior to entering the region labeled 6 of the electrofluidized bed. Charging of the particulate is accomplished by conventional ion impact at 2A. In the practical embodiment, the fluidizing air enters with the entrained particulate which is charged in the conventional manner by passage through a corona discharge or some other charging means. The entering air has a substantial vertical velocity component, as shown, so that the bed is substantially totally fluidized and maintained in that condition. The electrofluidized bed comprises sand or other collecting particles 17, for example, in a suspended or fluidized condition between screen electrodes 3A, 4A, 3B and 4B at the region 6. The electrodes 3A and 3B are connected together and to one side of a 60 Hz a-c or d-c (see d-c power supply 7A in FIG. 1B) power supply 7 (typically 15 kV with electrode spacing of four cm) and the electrodes 4A and 4B are connected together and to the other side of the power supply 7. A supply of sand 9 serves as a seed source when the apparatus 101 is started or on a continuous basis when the sand or the large particulate is recycled. As is discussed elsewhere herein, once the separation process has begun, agglomerated particulate can make up some or all the collecting particles in the region 6. The fluidized bed comprising the injected seed or the agglomerated particulate can be withdrawn in a fluidized form from the stack shown at 2 through a duct 8; in FIG. 4 the withdrawal is shown to be for analysis purposes or recycling. Clean gas leaves via the outlet at the top of the stack 2 and may be withdrawn by a roof fan as indicated. The co-flow system 101 further includes a Tyndall spectrometer 10 for measuring the size of aerosol from an aerosol generator 13; an extinction cell 11 determines aerosol density; a flow meter 12 measures gas velocity; the other elements need no explanation.

In the tests, the charged aerosol is mixed with the fluidizing air four cm below the distributor plate. Air velocity is monitored by means of a thermistor bridge near the intake. The experimental EFB itself consists of a pyrex test section whose inside diameter is 15 cm. The bed particles are injected at the top and removed from the side after an experimental test. The bed is supported by a 30 mesh copper screen, with the other three electrodes made of "hardware cloth" wire screen with square openings at ¼inch. Alternate electrodes are at the same potential and have a spacing $d$ of 4 cm. The aerosol "particulate" used in all tests has a mobility $b = 1.76 \times 10^{-7}$ (m/sec)/(volt/m) and diameter $2a = 0.7\mu$m.

The effect of particle spacing (dR), can be examined by operating with different flow rates and hence degrees of fluidization. FIG. 6 summarizes the collection efficiency measured at three different velocities as a function of voltage. (The distribution of particles between the three regions of the bed varied with U. For $U = 1.97$, the total fluidized height $l_f = 2l_o$ while for $U = 2.7$, $l_f = 4l_o$.) According to the model, normalization of the measured voltage to the velocity should correlate the efficiency with the single theoretical curve shown in FIG. 6. In fact, once V is large enough to dominate the collection, the three cases do have the same dependence, confirming the prediction that the unfluidized height is the basic length reflected in the collection performance.

Because the bed is so shallow in the cases represented by FIG. 6, the bed collection without an applied field is accentuated. There is in these cases approximately a 10% collection with no overt charging of the aerosol and 15 to 25% collection with charging but no applied field. In view of the long inertial scrubbing and self-precipitation times given by Eqs. (6) and (7), it seems most likely that this collection on the bed particles is due to turbulent diffusion and associated inertial impaction across a relatively thin boundary layer, together with some turbulent diffusion.

Humidity and the collected DOP itself tend to render the sand particles sufficiently conducting that charge accumulated on particles due to collection can leak away without apparently impairing the collection process. The results of a sequence of prolonged experiments are shown in FIG. 7. The amount of DOP collected continued to increase linearly with time over the test period of four hours. This supports the view that charge imparted to the collection sites by the aerosol has a short time for relaxation time from the bed compared to the collection time.

Because the role of the electric field is confined to carrying pollutants across a thin zone of air to the bed particle surface, and this process takes a relatively short time, it is expected that an alternating potential can be used as well as a d-c potential, for energizing the bed electrodes. In fact, this is found to be true. Collection efficiencies comparable to those described have been obtained with an rms voltage equal to the comparable d-c voltage.

The tests lend strong support to the physical significance of the simple model represented by Eqs. (3) and (4), provided of course that agglomeration is the result of a field induced impaction between particulate and bed particles. The implications of the model are appreciated by comparing the performance of the EFB to an ESP or a scrubber.

The collection law for the ESP takes the same form as Eq. (3). Assuming that ESP and EFB operate with comparable electric field intensities and gas velocities, the length $l_{ESP}$ of the precipitator equivalent to an unfluidized height $l_o$ of the EFB is $$l_{ESP} \cong \frac{1}{2} l_o \left(\frac{r}{R}\right) \tag{8}$$

where $r$ is the radius of a circular ESP collection electrode. Thus, for example, if $r = 0.1$m and $R = 0.4$mm, the length of the comparable ESP would be more than 100 times $l_o$.

From a residence-time point of view, the inertial scrubber is inferior to even the ESP in the removal of submicron particulate. Performance can be improved by charging the drops and particulate and hence taking advantage of field induced collection. Limitations inherent to such devices are encapsulated in a time constant point of view that typifies the collection process by the characteristic time $\tau_c = \epsilon_o/NQb$ (where $N$ is the density of drops and Q is their net charge) and typifies the rate at which these drops are lost from the volume or lose their net charge by $\tau_R = \epsilon_o/NQB$, where B is the mobility of the drop itself. The problem in charged drop scrubbers is that $\tau_c$ generally exceeds $\tau_R$, and so inefficient use is made of the drops. In the EFB, the collection is similarly governed by the ratio of a collection time constant to the residence time, as is seen by writing Eq. (4) as $$\frac{l_c}{l_f} = \frac{[\epsilon_o/NQ_1b]}{[l_f/U]} \tag{9}$$

where $Q_{1/2}$ is the net charge induced by the imposed field on one hemisphere of a bed particle. Because the particles do not carry a net charge, there is no limitation from the effective particle life-time analogous to that imposed by the short $\tau_R$ in a charged drop scrubber. But to make it worthwhile to use either particles or drops as collection sites using the polarizing ambient field rather than simply using the electrodes which must be provided to impose the field anyway, the sites must have a greater surface area than the electrodes. For an ESP having circular electrodes, the ratio of collecting areas for ESP and EFB having the same volume is $$\frac{A_{EFB}}{A_{ESP}} = \pi\left(\frac{r}{R}\right)\frac{1}{\alpha^3} \tag{10}$$

The break-even site density is with $\alpha = \sqrt[3]{\pi(r/R)}$. Such small site spacings, although very difficult to achieve with drops, are easily obtained in the EFB.

Finally, it must be observed that at least in working with relatively insulating beds and particulate, the major price paid for the extremely short residence time and convenience of having the pollutant in a fluidized form is in the increased pressure drop. Fortunately, the EFB pressure drop is easily approximated. FIG. 8 shows a typical dependence of $\Delta p$ is simply the pressure required to support the bed particles (the dotted line in FIG. 8) plus what drop there is across the distributor plate (the element shown at 21 in FIGS. 1A and 9). (Although electromechanical effects on the bed are not of importance under the relatively low field conditions used, the effects can in fact be dramatic. For example, at very high field strengths, the field can freeze the bed, or it can be used to electromechanically suspend the bed.) The ratio of pressure drop through the EFB to that through an ESP is approximately $$\frac{(\Delta p)_{EFB}}{(\Delta p)_{ESP}} = \frac{l_o \rho_s g}{f\left(\frac{2l}{r}\right)\left(\frac{\rho_g U^2}{2}\right)} \tag{11}$$

where $f$ is the ESP friction factor, $\rho_g$ is the gas mass density, $\rho_s$ is the effective particle mass density (density corrected for bed voidage) and $g$ is 9.8m/sec$^2$. For comparable performance of devices using similar values of $bE$ and $U$, $l_{ESP}/r \cong l_o/R$ and then Eq. (11) becomes $$\frac{(\Delta p)_{EFB}}{(\Delta p)_{ESP}} = \frac{2R\rho_s g}{f\rho_g U^2} \tag{12}$$

Thus, for example, with $f = 0.06$, $R = 4 \times 10^{-4}$m, $\rho_s = 10^3$kg/m$^3$, $\rho_g = 1$kg/m$^3$ and $U = 2$m/sec, the pressure drop through the EFB exceeds that through an ESP by a factor of about 30. Because the pressure drop through an ESP is not usually a major consideration, this factor is not out of line with many uses. In any case, the question of what pressure drop is required is answered by determining the unfluidized bed height necessary to achieve the required performance. For the removal of 0.7 $\mu$m particulate, the efficiencies of FIG. 4 are obtained with a pressure drop equivalent to 7 cm of water.

The high performance in the removal of submicron particulate inherent to the EFB is substantiated by the experiments. The extremely short residence times that can be achieved make the EFB suited to solving problems of fume collection and the control of oil ash. By making the bed particles agglomerates of the pollutant itself, the EFB operates as a self-agglomeration device. In this class of EFB, there is no requirement for recycling the bed particles, since their removal constitutes the final stage of removal of the particulate.

The electrofluidized bed in FIG. 4 has relatively small cross-sectional dimensions. In most stacks such beds will be much larger in cross-sectional dimensions than shown. The velocity of the gas through the bed is limited by the elutriation of bed particles. In situations where the cross-sectional dimensions are limited, the beds can be manifolded as shown in FIG. 9 so as to retain the required gas velocity through the bed. The electrofluidized beds are shown with the cross-flow configuration of FIG. 1A. It will be appreciated that the manifolded arrangement of FIG. 9 essentially contains a plurality of the collection cells shown in FIG. 1A with appropriate baffling to direct gas flow. Each cell comprises a cell wall or duct, not shown in either figure. In the cross flow configuration of FIGS. 1A and 9, the gas passes longitudinally between at least two transversely or laterally separated electrodes that are labeled 20A and 20B throughout. The electrodes 20A and 20B are energized by the potential source 7A to provide a transversely directed ambient electric field in the region occupied by the bed particles 17, and the electrofluidized bed is simply designated EFB. (Similar manifolding can be employed with the co-flow configuration of FIG. 1B.) Incoming gas moves upward, as indicated by arrows A passing through distributor plate 21 into an EFB between the electrodes 20A and 20B; clean air leaves the EFB region as indicated by arrows B. Bed particles are removed, as before, and disposed and/or fed back to seed to bed region. A cover on the collection system of FIG. 9 forces the polluted air through the EFB system. The distributor plates 21 like the electrodes 4B, etc. in FIG. 4, prevent leakage of the particles from the bed; perforations in the distributor plate 21 must be small enough to prevent leakage but sufficiently large to prevent undue back pressure on the gas. For a particular distributor plate that may be employed, see an application for for Letters Patent entitled "Apparatus for Support and Stabilization of Packed and Fluidized Beds", S.N. 516,056 filed Oct. 18, 1974 (Melcher et al) that accompanies herewith and that is assigned to the same assignee as the present application.

Modifications of the invention herein disclosed will occur to persons skilled in the art and all such modifications are deemed to be within the spirit and scope of the invention as defined by the appended claims.

What is claimed is:

1. Apparatus for electrostatically removing particulate from a gas, said apparatus comprising means for electrically charging the particulate; a housing containing a bed of particles, means for moving a stream of gas, including gas containing said particulate, into and through said bed with a substantial vertical velocity component for substantially totally fluidizing said bed and maintaining said bed substantially totally fluidized; and means for imposing an electric field upon the particles of the bed to create an electrofluidized bed, said means being operable to maintain the electric field intensity sufficiently high to induce substantial positive and negative surface charges at respective ends of said particles but sufficiently low that there is no substantial electrical discharge in the bed region, said charged particulate being electrically attracted by the charged surfaces of the particles of the electrofluidized bed and collected upon the particles of the electrofluidized bed and thereby being removed from the stream.

2. Apparatus as claimed in claim 1 having means to remove the particles of the fluidized bed from said housing while the removed particles are fluidized.

3. Apparatus as claimed in claim 2 in which the means to remove the particles of the fluidized bed comprises a substantially horizontal duct through which the fluidized bed particles flow from the housing.

4. Apparatus as claimed in claim 1 that includes means to seed the region of the fluidized bed in said housing to initiate particulate precipitation, at least a portion of the particles that thereafter form the bed being originally said particulate.

5. Apparatus as claimed in claim 1 in which said housing comprises a substantially vertical duct through which the gas flows upward in a generally longitudinal direction and in which said field imposing means comprises at least two electrodes separated transversely with respect to said longitudinal direction and means for energizing said electrodes at alternate polarities, the energized electrodes providing a substantially transversely directed ambient electric field in the region of said housing occupied by the bed particles; and a gas-porous distributor plate beneath said electrofluidized bed to prevent leakage of the particles from the electrofluidized bed, the gas moving upward through the distributor plate acting to separate particles from the distributor plate and from each other.

6. Apparatus as claimed in claim 5 in which the means for energizing is an a-c source of electric potential.

7. Apparatus as claimed in claim 5 in which said duct, electrodes, energizing means, particles, and distributor plate constitute a cell, said apparatus comprising a plurality of such cells in a manifold arrangement, each cell acting to remove particulate from the gas.

8. Apparatus as claimed in claim 5 in which the means for energizing is a d-c source of electric potential.

9. Apparatus as claimed in claim 1 in which said housing comprises a substantially vertical duct through which the gas flows upward in a generally longitudinal direction and in which said field imposing means comprises a plurality of screen-like electrodes extending across the duct transversely to said longitudinal direction, separated from each other longitudinally within the duct, and occupying the whole cross section of the duct so that the gas in its upward flow passes through one part or the other of the screen-like electrodes, said bed comprising particles disposed upon the upper surface of the lower of the screen-like electrodes, the mesh of the lower screen-like electrode being sufficiently large to prevent undue back pressure upon the gas but small enough to prevent leakage of the bed particles, the gas moving upward through the particles acting to separate particles from the screen-like electrodes and from each other to fluidize the bed, and means for energizing the screen-like electrodes at alternate polarity potentials.

10. Apparatus as claimed in claim 9 in which the means for energizing is an a-c source of electric potential.

11. Apparatus as claimed in claim 9 in which the means for energizing is a d-c source of electric potential.

12. Apparatus as claimed in claim 1 in which the particles constituting the fluidized bed are insulating, having relaxation times $\sim 0.1$ seconds.

13. Apparatus as claimed in claim 12 in which said particles are sand.

14. Apparatus as claimed in claim 13 in which the said particles forming the bed have mean diameters in the range between about 0.8 mm and 2 mm.

15. Apparatus as claimed in claim 1 in which the particles constituting the fluidized bed are semi-insulating, having relaxation times $\sim 10^{-1}$–$10^{-8}$ seconds.

16. Apparatus as claimed in claim 1 in which said housing comprises a substantially vertical duct through which the gas flows upward in a generally longitudinal direction and in which said field imposing means comprises electrodes at either side of the duct and extending longitudinally along the duct so that the gas in its upward flow passes between the electrodes, said bed comprising particles disposed between the electrodes, the gas moving upward through the particles acting to maintain the particles in a fluidized state to form a fluidized bed, and means for charging the electrodes, the charged electrodes providing an ambient electric field in the region of the housing occupied by the particles.

17. Apparatus as claimed in claim 1 in which the particles forming the bed have mean diameters in the range between about 0.8 mm and 2 mm.

18. Apparatus as claimed in claim 1 in which the particles forming the bed have mean diameters smaller than about 2 mm but large enough so that no substantial elutriation of said particles occurs.

19. A method of removing particulate from a gas in which the particulate is entrained, that comprises: forming a bed of particles; creating an electric ambient field in the region occupied by the bed to impose an electric field upon the particles and thereby create a bed of particles supporting surface charge; controlling the intensity of the electric field in the bed at a level of intensity sufficiently high to induce substantial positive and negative surface charges at respective ends of the particles comprising the bed but sufficiently low to prevent substantial electrical discharge within the bed region, charging the particulate upstream of the bed, and passing gas, including the gas containing the previously charged particulate, through the bed with a substantial vertical velocity component to substantially totally fluidize said bed and maintain the same substantially totally fluidized, thereby providing an electrofluidized bed wherein the bed particles are electrically polarized, said charged particulate being attracted to the thusly polarized particles by electrical attraction and being collected upon the particles.

20. A method as claimed in claim 19 that further includes introducing additional gas to provide sufficient flow for fluidization of the bed in situations wherein the natural flow is insufficient to effect proper fluidization.

21. Apparatus that comprises, in combination, a housing containing a bed of particles; means moving a stream of fluid, including particulate to be removed, through said bed with a substantial vertical velocity component for substantially totally fluidizing said bed and maintaining it substantially totally fluidized; and a source of electric potential and electrode means for imposing an electric field upon the particles of the bed to create an electrofluidized bed, the electric field intensity throughout the bed being sufficiently high to induce substantial positive and negative charges at respective ends of said particles and thus provide electrically polarized bed particles, but sufficiently low that there is no substantial electrical discharge within the bed region.

22. Apparatus for electrostatically removing particulate from a gas, that comprises, means electrically charging the particulate; a housing containing a bed of particles; means moving gas, including the gas containing the charged particulate, into and through the bed with a substantial vertical velocity component for substantially totally fluidizing the bed and maintaining it substantially totally fluidized; means imposing an electric field in the region of the housing occupied by the particles to create an electrofluidized bed, said means for imposing being regulated to provide an electric field intensity in said region sufficiently high to induce substantial positive and negative surface charges at respective ends of the particles comprising the bed but sufficiently low to prevent substantial electrical discharge within the electrofluidized bed, field induced collection of the particulate on the thusly polarized particles occurring within the electrofluidized bed; and means to effect outflow of the particles and the collected particulate from the region of the electric field while the outflowing particles are fluidized.

* * * * *